US005350084A

United States Patent [19]

Miller et al.

[11] Patent Number: 5,350,084

[45] Date of Patent: Sep. 27, 1994

[54] MIXING, METERING AND DISPENSING DEVICE

[75] Inventors: Kenneth L. Miller, Indianapolis, Ind.; Mark E. Centea, Akron, Ohio

[73] Assignee: Liquid Control Corporation, North Canton, Ohio

[21] Appl. No.: 115,820

[22] Filed: Sep. 3, 1993

[51] Int. Cl.[5] ..... B67D 5/52

[52] U.S. Cl. ..... 222/137; 222/145; 222/309; 222/334

[58] Field of Search ..... 222/1, 137, 145, 263, 222/265, 266, 275, 278, 249, 250, 309, 334, 365, 389

[56] References Cited

U.S. PATENT DOCUMENTS

| | | | |
|---|---|---|---|
| 2,826,342 | 3/1958 | Clark et al. | 222/265 |
| 3,431,953 | 3/1969 | Rutherford | 222/334 |
| 3,806,084 | 4/1974 | Seese | 251/63 |
| 4,055,281 | 10/1977 | Rosen et al. | 222/334 |
| 4,095,722 | 6/1978 | Miller | 222/1 |
| 4,116,364 | 9/1978 | Culbertson et al. | 222/334 |
| 4,942,984 | 7/1990 | Miller | 222/309 |
| 4,974,755 | 12/1990 | Sonntag | 222/365 |
| 5,092,492 | 3/1992 | Centea | 222/137 |

OTHER PUBLICATIONS

SCM/Dispensit Brochure, 1990.

*Primary Examiner*—Andres Kashnikow
*Assistant Examiner*—Philippe Derakshani
*Attorney, Agent, or Firm*—Michael Sand Co.

[57] ABSTRACT

A positive displacement material mixing, metering and dispensing device having a housing with a pair of material inlet ports, and a pair of material outlet ports which are in communication with a pair of holding cavities, and a pair of valve chambers. A spool is slidably mounted in each of said valve chambers. An air actuated piston is in contact with opposite ends of the spools. Each spool has a reduced diameter central portion which communicates with a respective one of the material holding cavities at all times, but is in communication with the inlet and outlet ports only at discrete positions in the operating cycle and is never in communication with both the inlet and outlet ports simultaneously. One end of a pair of push rods moves into and out of the material holding cavities, with the other ends of the push rods being simultaneously actuated by an air piston. In operation, the central portions of the spools are first moved into communication with the inlet ports to accept two different materials through the central portions, and into the holding cavities. The central portions of the spools are then moved out of communication with the inlet ports, and into communication with the outlet ports. Thereafter, the push rods are moved into the holding cavities and the materials held therein are forced through the central portions and through the outlet ports to provide for the positive discharge of the dual materials into a static mixer. The push rods are then moved out of the material holding cavities, and the central portions are moved back into communication with the inlet ports to receive second shots of the two materials.

19 Claims, 8 Drawing Sheets

MIXING, METERING AND DISPENSING DEVICE

BACKGROUND OF THE INVENTION

1. Technical Field

The invention relates to a dispensing device. More particularly, the invention relates to a portable self-contained pneumatic gun for dispensing metered and mixed plural component flowable materials. Specifically, the invention relates to a portable dispensing pneumatic gun for plural component liquids in which the plural components are accurately metered and mixed adjacent to the point of dispensing.

2. Background Information

An ever increasing number of products used in everyday life require the dispensing of liquid or semi-liquid flowable materials in one form or another for their manufacture. These flowable materials typically comprise two component reactive resins. The types of materials dispensed include virtually any flowable liquid, semi-liquid, or paste such as epoxies, polyurethanes, silicones, polyester, acrylics, polysulfides and phenolics, for example. Common commercial manufacturing processes in which such materials are used include injecting precise amounts of mixed resins into molds, encapsulating electric components with insulating resins, applying continuous beads of structural adhesives, injecting polyester into closed molds, sealing joints with two part polysulfides, and numerous other functions requiring the accurate control, delivery and mixing of two reactive component materials. Examples of product application include under the hood electronic assemblies and safety devices for the automotive and trucking industry, encapsulation of magnetic and other advanced electrical devices for the air and space industry, component mounting, security potting and gun type applications for circuit board assemblies, and components and apparatus such as switches, power supplies, heating assemblies, and other electronic components for the appliance industry.

Thus, as the aforesaid flowable mixed materials continue to be consumed in increasing quantities, the demand for precise liquid and semi-liquid metering, mixing and dispensing devices is also growing at an accelerated rate. The industry is continuously searching for more reliable, efficient and accurate metering, mixing and dispensing device for plural component flowable materials for a variety of purposes. For example, a particular application may require that a device efficiently and accurately dispenses such plural materials ranging in amounts from less than 1 cubic centimeter to many gallons. However, although the industry is calling for more exact device, it is also requiring that the device design be simple, and capable of being operated by production personnel or conveniently integrated with automation devices such as robots and conveyor systems. Problems currently exist because many prior art plural component metering, mixing and dispensing device are immobile, requiring that the work be brought to the device which most often is inefficient and impractical.

Prior art metering, mixing and dispensing devices for two component liquid materials such as shown in U.S. Pat. No. 5,092,492, require the use of check values usually of the spring-biased ball detent arrangement, for controlling the flow of the two components through their respective discharge openings. Although these prior art dispensing devices using check valves are satisfactory for certain applications, they have certain drawbacks, especially when used with a high viscosity liquid and higher pressure. Likewise, with certain types of particle filled liquids, the particles could cause problems by eventually fouling and effecting the operation of the spring-biased ball check valves. Furthermore, such check valves when used in pairs, are difficult to accurately control the liquid being dispensed, especially when used in very small shot applications, such as for one cubic centimeter, since the proportion of the two liquids must be extremely accurate to achieve the desired reaction when the two components are mixed. Furthermore, the use of spring-biased ball check valves do not provide any "snuff back" effect which is desirable in certain applications to prevent excess material from dropping from the discharge nozzle. Thus, it is desirable that a positive pressure dispensing device be utilized which does not rely on check valves for their operation. However, such positive dispensing devices have only been used for the discharge of a single amount of a liquid and not for the simultaneous discharge of two components in extremely accurate amounts which are then subsequently mixed and dispensed.

One type of single liquid positive pressure dispensing device is described in U.S. Pat. No. 3,806,084, issued to R. J. Seese and entitled "Improved Valve Dispensing Apparatus". The Seese patent describes a dispensing device comprising a housing having a tubular chamber which communicates with the material inlet and exit port, and a unitary valve member defined in the passageway. The valve member is slidable in the chamber. The Seese patent describes a wiping action on the chamber by the valve member during its return stage, which causes a suction force on undispensed material, thereby preventing the sauter from dripping out of the exit port.

U.S. Pat. No. 4,095,722 issued to K. L. Miller entitled "Dripless Dispenser and Methods of Dispensing a Flowable Material", describes another type of positive pressure dispenser for a single liquid, using a bore and a pinch off tube fitted within the bore. A single flowable material reservoir is connected to one end of the pinch off tube, and a dispensing nozzle or needle is removably coupled to the other end of the tube. The pinch off tube is squeezed to dispense a shot of single flowable material. Release of the squeezed pinch off tube causes the residual material in the pinch off tube to be drawn back away from the dispensing point.

U.S. Pat. No. 4,942,984, issued to K. L. Miller entitled "Dripless Sauter Paste Dispenser" describes another single liquid positive displacement dispensing gun, using three pressure chambers wherein pressure is altered in the pistons to achieve a three stage operating system. Specifically, the resting stage is characterized by having the reservoir tube opened. To dispense a shot of semi-solid material, the positive pressure in the upper pressure chamber is reduced. The middle pressure chamber is not yet pressurized and the reduction in the upper chamber pressure enables the positive pressure in the lower chamber to force the lower piston upward, which in turn mechanically pushes the reciprocating drive rod and dispensing rod tip upward. This movement then allows semi-solid material to flow into the dispensing tube. Thereafter, the middle and upper chambers are then pressurized and the reciprocating drive rod travels downward for a predetermined distance coincident with the long axis of the housing. This in turn pushes the dispensing rod tip down to dispense a precise amount of a single component semi-solid material through the outlet port.

Another type of positive displacement system for dispensing a single fluid is described in Publication SCM/Dispensit dated 1990 and distributed by SCM Metal Products, Inc. identified by its Models: 1,000 series. This dispenser provides for the positive dispensing of a single shot of material, which although satisfactory for its intended purpose, does not enable the simultaneous dispensing matering and mixing of two components as required by the device of the present invention.

Another problem with dual component metering, mixing and dispensing devices is that the starting and stopping of the flow of both liquids simultaneously is critical in order to achieve the required uniform mixing which is essential for many applications. This is also a problem at the start-up of a dispensing operation due to the formation of air bubbles and pockets in the dispensing lines and chambers. Therefore, there is a need to be able to purge such air from the device at start-up to ensure that the initial shots of material are accurately mixed to prevent the wasting of materials or formation of improper shots of the dual liquids at start-up.

Moreover, the design of many types of the prior art metering, mixing and dispensing device, due to their bulky nature and the inability to position the apparatus in close proximity to the worker, require lengthy hoses for transport of the metered and/or mixed material, the components of which often begin to react prematurely, sometime before it is actually dispensed, which is highly undesirable. Rather, it is preferable that the dual flowable materials be metered and mixed as closely as possible to the point of dispensation or application to avoid premature reaction of the materials. Also, locating the metering and mixing components of the device as closely as possible to the dispensing point increases metering accuracy and control.

Another problem with known dual component dispensing guns is the matter of overrun discharge of the flowable materials when dispensation is stopped or terminated. The slow release of pressure on a piston member causes the materials to continue to flow at a decreased rate until pressure is fully relieved resulting in inaccurate dispensing and improper ratios of the mixed materials. Where two component materials are dispensed simultaneously, they may have different flow and viscosity characteristics accentuating the inaccuracy of desired delivery. Loss of precise delivery of desired amounts is a frequent problem, especially where small volumes are dispensed, and when spring-biased ball check valves are utilized as in known dual liquid dispensing equipment.

In the past, the deposition of adhesives, sealants, lubricants and the like has been plagued by other problems. In the absence of any type of a positive displacement mechanical dispenser, the application of such materials is more often than not a messy and inaccurate operation. Frequently, an expensive substance is haphazardly applied, wasting valuable material and generating unnecessary cleanup costs. Even the use of one of the many types of dispensers heretofore known to those skilled in the art has failed to eliminate all of the problems. While many of these dispensing devices may dispense certain materials accurately, they are still not capable of producing uniform shots of a two component flowable material, the viscosities of which are subject to change, a common phenomenon in flowable materials such as epoxy resin adhesives, nor can they accommodate a variety of materials having a wide range of viscosities. Conventional dispensers may reduce the waste material, but the necessary periodic readjustment of these dispensing devices produces undesirable "downtime", creating inefficiencies in a common production process situation.

Therefore, the need exists for an improved liquid metering, mixing and dispensing device in which plural component materials are metered and mixed adjacent to the point of dispensing thereof, and which device is portable enough to be handled by a human operator or easily integrated with automated systems. Moreover, the need also exists for an improved liquid metering, mixing and dispensing machine wherein overrun discharge is controlled as pressure is removed from the discharge tip immediately after discharge, while simultaneously the reservoir inlet is occluded during the dispensing operation. Further, the need exists for such a device wherein a plurality of materials may be simultaneously metered, at different rates, wherein an exact predetermined amount of each material may be dispensed into a mixing head.

SUMMARY OF THE INVENTION

Objectives of the invention include providing a liquid metering, mixing and dispensing device in which plural component liquids are positively metered and mixed adjacent to the dispensing location.

Another objective of the invention is to provide such a positive displacement liquid metering, mixing and dispensing device which is portable and easily handled by a human operator, and which can be conveniently integrated into automation systems.

A still further objective of the invention is to provide such a liquid metering, mixing and dispensing device which allows for accurate volume and rate variability, which can accurately dispense materials comprised of components having widely varying ratios.

Still another objective of the invention is to provide such a positive displacement liquid metering, mixing and dispensing device which can dispense liquids having a wide range of viscosities and cure times.

A still further objective is to provide such a liquid metering, mixing and dispensing device which is accurate in dispensing low volume output shots which are consistent and reliable, and which device is portable for accessing heretofore inaccessible locations, and is lightweight, compact and durable.

It is still a further objective of the invention to provide an improved method of dispensing a flowable material which controls overrun discharge, which removes pressure from the discharge port immediately after a shot has been discharged, and which can provide a "snuff back" effect.

A still further objective of the invention is to provide an improved method of dispensing a flowable material which occludes the reservoir inlet during all portions of the operation cycle wherein material is not being fed into the discharge chamber.

Another objective of the invention is to provide such an improved positive displacement dispensing device which eliminates the use of any spring-biased ball check valves, and which enables the device to be purged of trapped air at the time of start-up to prevent initial inaccurate metering, mixing and dispensing of the dual components.

A still further objective is to provide such a positive displacement metering, mixing and dispensing device which is of simple construction, which achieves the states objectives in a simple, effective and inexpensive manner, which solves problems and satisfies needs existing in the art.

These and other advantages and objectives of the invention are obtained by the positive displacement device of the present invention for simultaneously metering, mixing and discharging two flowable materials, the general nature of which may be stated as including a housing defining a pair of chambers each communicating with a material inlet port and a material outlet port for dispensing a respective material therefrom; a spool slidably mounted within each of the chambers wherein said spools communicate discretely with said material inlet and outlet ports; a holding means in communication with each of the chambers for receiving and holding a volume of one of the materials after said materials enter said inlet ports and passes said spools; a single first pressure means for forcing the materials simultaneously out of said holding means and past said spools and through said material outlet ports; and second pressure means for slidably moving the spools between a first position where said holding means are in communication with said material inlet ports, and a second position where the holding means are in communication with said material outlet ports.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
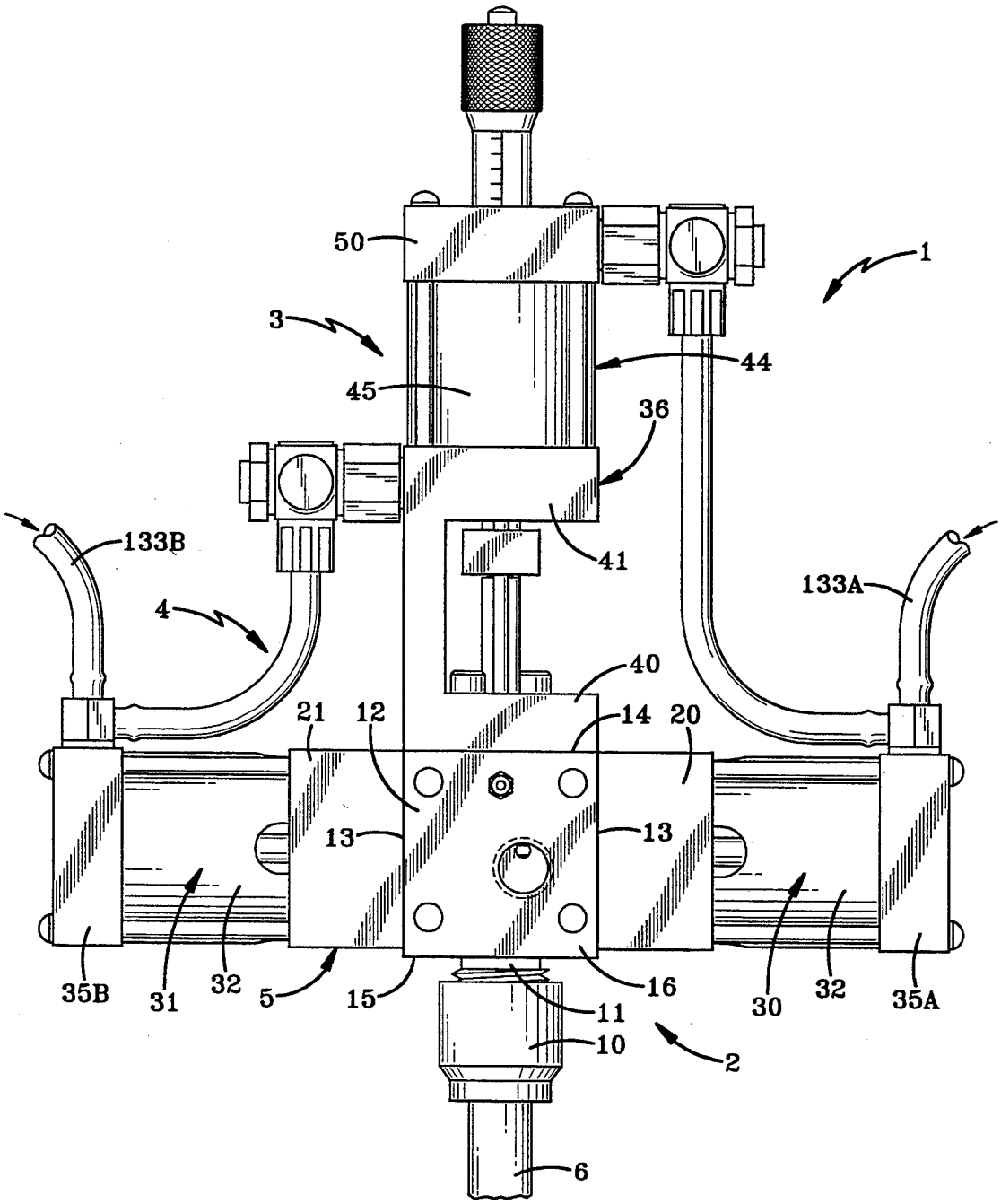
FIG. 1 is an elevational front view of the mixing, metering and dispensing device of the present invention.

The mixing, metering and dispensing device of the present invention is indicated generally at the numeral 1, and is shown specifically in FIGS. 1–10. Device 1 preferably includes as its main components a valve assembly 2, dispensing assembly 3, and a pressurized fluid system 4 (FIG. 1). Valve assembly 2, dispensing assembly 3 and a portion of fluid system 4 operate within a housing 5. Further, device 1 includes a usual static mixer dispensing tip 6 which has an open end (not shown) for dispensing a shot of material, and a second threaded end 10. Threaded end 10 is threadably engaged onto a threaded boss 11, such that tip 6 may be replaced or removed fro cleaning. Tip 6 may be a type of static mixer generally well known in the art, such as shown in U.S. Pat. No. 5,092,492.

Figure 2:
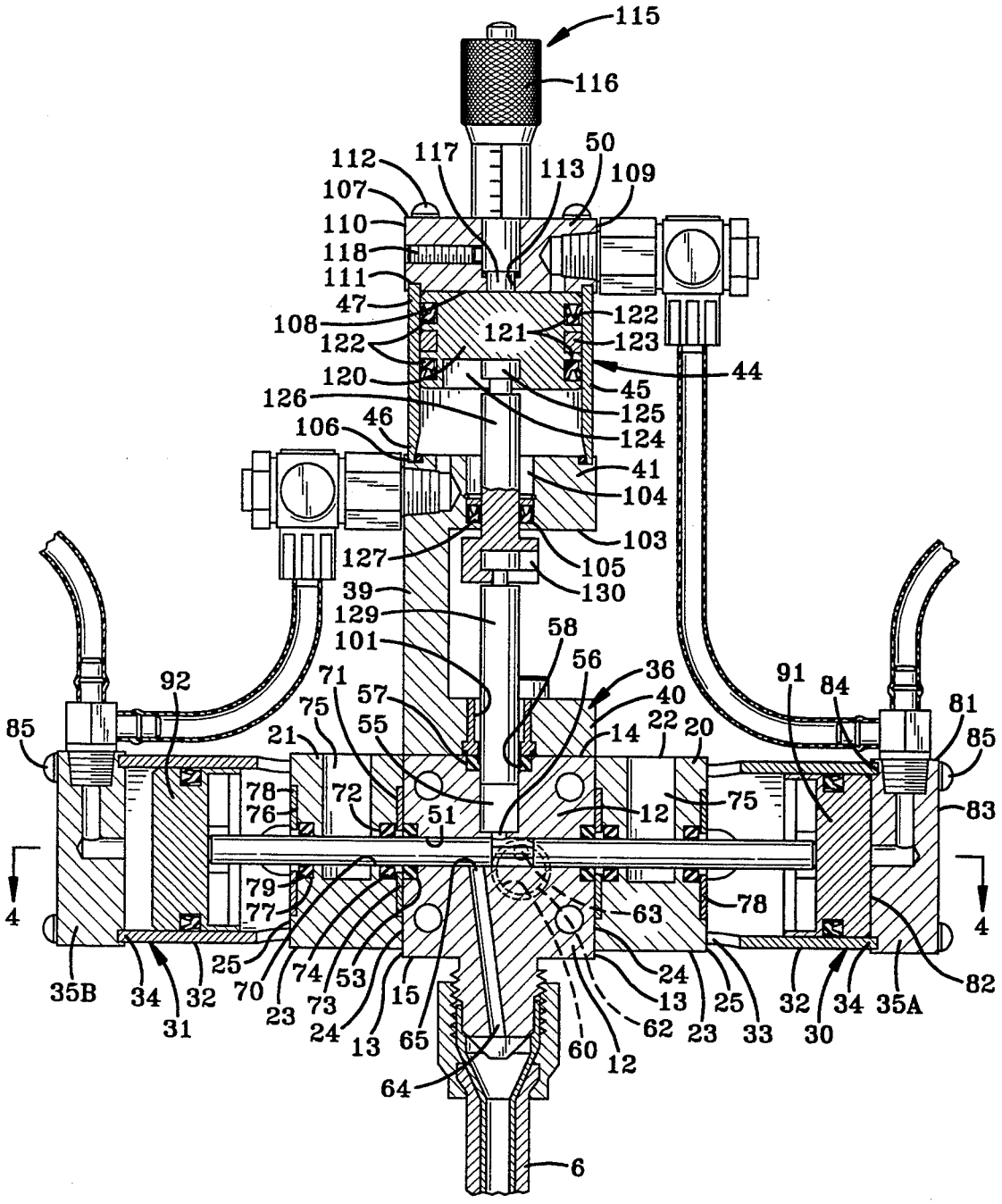
FIG. 2 is a sectional view of the device as shown in FIG. 1 taken along line 2—2, FIG. 5.
Figure 3:
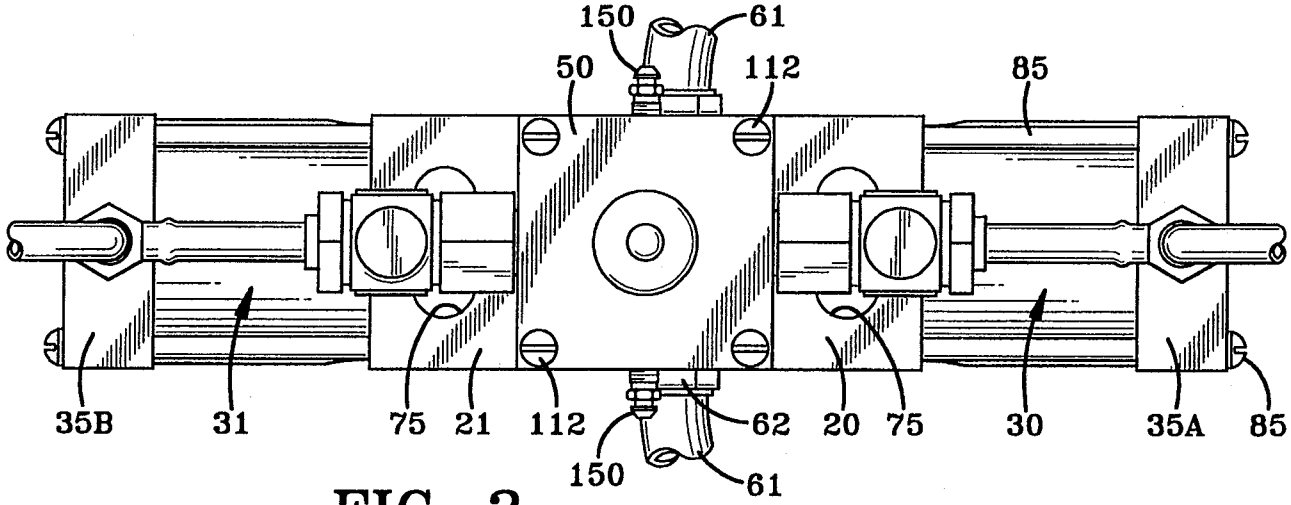
FIG. 3 is a top plan view of the device.
Figure 4:
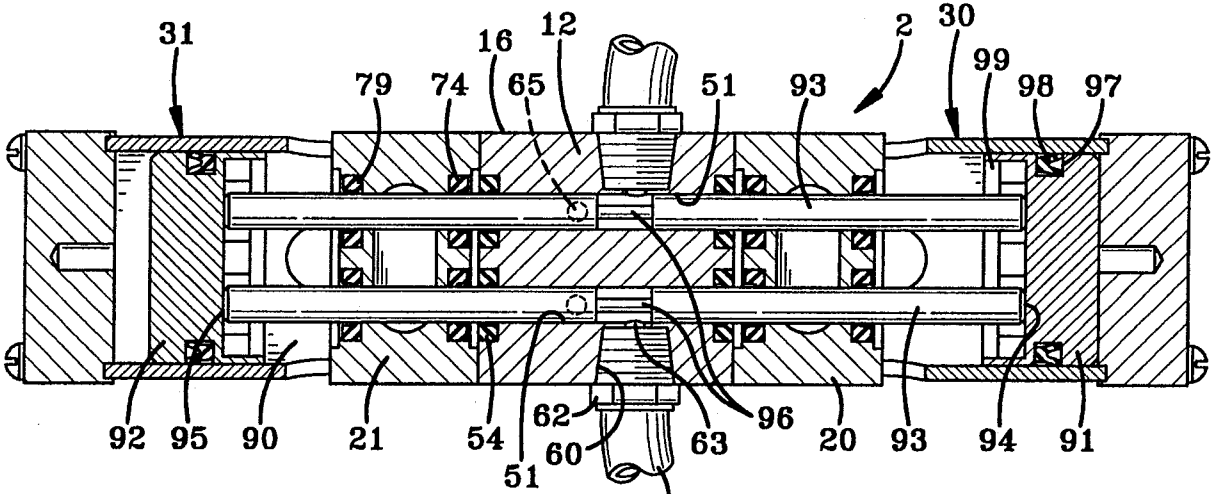
FIG. 4 is a sectional view taken along lines 4—4, FIG. 2.
Figure 6:
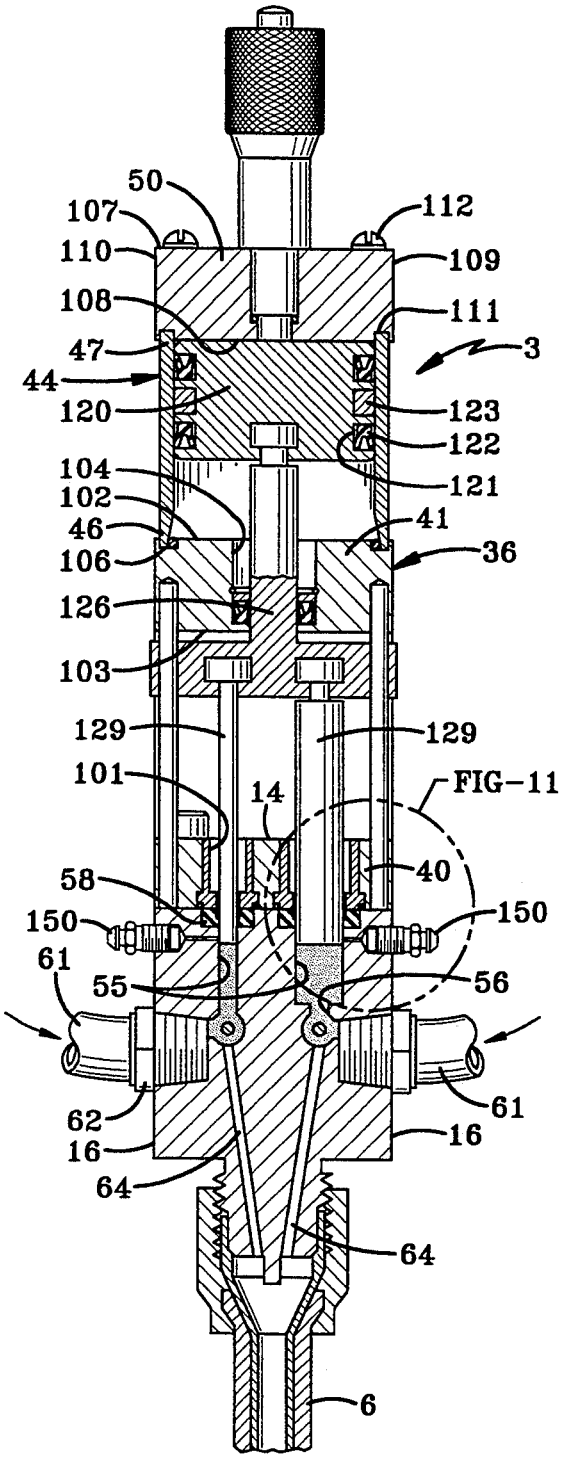
FIG. 6 is a sectional view of the device taken along line 6—6, FIG. 7.

Referring to FIGS. 2, 4 and 6, housing 5 includes a base 12 having opposing sides 13, an upper surface 14, a lower surface 15 and face walls 16. Boss 11 extends outwardly from lower surface 15.

A pair of reservoir members 20 and 21 are mounted on opposite sides of base 12. Each reservoir member includes an upper surface 22, a lower surface 23, an inner sidewall 24, and an outer sidewall 25. Inner sidewall 24 of each reservoir member is in mating contact with a respective side 13 of base 12. Valve cylinders 30 and 31 are attached to respective sidewalls 25 and are each formed by a cylindrical sidewall 32, which sidewall has a first end 33 and a second end 34. First ends 33 are attached to a sidewall 25 of a respective reservoir member 20 and 21. The second ends 34 of cylinders 30 and 31 are enclosed by a cover plate 35.

A substantially C-shaped push rod clip 36 (FIGS. 1 and 2) is mounted on upper surface 14 of base 12, and includes a sidewall 39 and spaced apart bottom and top walls 40 and 41. Bottom wall 40 abuttingly engages upper surface 14 of base 12. A dispensing cylinder 44 is mounted on top wall 41 and has a cylindrically shaped sidewall 45 with a first end 46 and a second end 47. First end 46 is mounted on top wall 41 of push rod clip 36, and a top cover plate 50 is attached to end 47.

In accordance with one of the features of the invention, a pair of cylindrical chambers 51 are formed in and extend completely through base 12 ending at annular recesses 53 formed in sides 13 (FIGS. 2, 4 and 7–10). Each recess 53 retains a complementarily shaped annular seal 54. Upper surface 14 of base 12 includes a pair of holding cavities 55 (FIG. 6) in operative communication with chambers 51 via runners 56. Surface 14 also includes a pair of annular recesses 57 in which are seated complementarily shaped annular seals 58. A material inlet port 60 extends through each face wall 16 (FIGS. 4 and 6), and includes a material feed tube 61, threadably engaged with base 12 at fittings 62. Each port 60 communicates with a respective chamber 51 at an opening 63. One end of a pair of runners 64 communicates with dispensing tip 6, and the other ends of runners 64 communicate with chambers 51 at material outlet ports 65 to accept material from chambers 51.

Referring again to FIGS. 2 and 4, reservoir members 20 and 21 are similar, and thus only member 21 will be described in complete detail. A cylindrical aperture 70 extends through reservoir member 21 and is coaxial and in communication with chamber 51. Annular cavities 72 are formed in sides 24 of base 12 and complementarily shaped annular seals 74 are retained therein by retaining washers 71. Outer sidewall 25 present first and second annular cavities 76 and 77, respectively, which retain complementarily shaped annular seals 79, and retaining rings 78 which are coaxial with aperture 70 and chamber 51. Upper surface 22 includes a bath 75 which holds a lubricant (not shown), and is in direct communication with apertures 70. In the preferred embodiment, bath 75 extends inwardly into reservoir 21 past the point where apertures 70 pass therethrough, such that bath 75 and apertures 70 intersect.

Valve cylinders 30 and 31 (FIG. 2) are similar, and thus, only cylinder 30 will be described in detail. As discussed above, cylindrical sidewall 32 of valve cylinder 30 has first and second ends 33 and 34. End 33 is mounted onto outer sidewall 25 of reservoir 20 such that annular seal 79 and ring 78 are facing into open valve cylinder 30. The second end of sidewall 32 is closed by a cover plate 35 secured to reservoir 20 by bolts 85 or other attachment means. Bolts 85 may be removed and the valve assembly disassembled to permit cleaning and replacement of worn parts in a relatively quick and inexpensive manner.

In further accordance with the invention, a pair of cylindrical spools 93 are interposed between a pair of pistons 91 and 92, which pistons are slidably mounted in valve cylinders 30 and 31, respectively. Spools 93 are complementarily sized to slidably mount within chambers 51 and apertures 70. Moreover, ends 94 and 95 of spools 93 extend outwardly from each aperture 70 and into valve cylinders 30 and 31.

Each spool 93 (FIG. 4) has a diameter substantially equal to that of the interior of chamber 51 such that it is slidably mounted therein, and creates a sliding seal with seals 54, 74 and 79. Each spool 93 includes a central portion 96 of reduced diameter, which portion is substantially narrower than the diameter of the remainder of spool 93, and is positioned in the center of the spool. Central portion 96 is sized lengthwise or axially, such that when in one position it will communicate between holding cavity 55 and inlet port 60, and in a second position it will communicate between holding cavity 55 and outlet port 65. Moreover, when portion 96 is in communication with either inlet port 60 or outlet port 65, it will not be in communication with the other of inlet port 60 or outlet port 65.

Each end 94 and 95 of spools 93 abuts a respective piston 91 and 92. Each piston is substantially complementarily shaped with the interior of the valve cylinder and has an annular recess 97 extending around its sidewall. Recess 97 houses an annular seal 98 for sealing the engagement between the piston and the valve cylinder. Further, a magnetic ring 99 is attached to each piston for use with an external magnetic control of the type generally known in the dispensing art. Ring 99 may be of any shape, and may be attached to the piston by any convenient attachment means without departing from the spirit of the present invention.

Considering dispensing assembly 3 (FIGS. 2 and 6), bottom wall 40 of push rod clip 36 is mounted onto upper surface 14 of base 12. An aperture 101 extends through bottom wall 40 and is in axial alignment with holding cavity 55. Top wall 41 has an upper and lower surface 102 and 103. Upper surface 102 has a dado 106 to accept first end 46 of dispensing cylinder 44. A seal is then interposed between the cylinder 44 and clip 36 to seal the connection therebetween. Upper surface 102 also provides a substantially cylindrical bore 104 through the center thereof. In the preferred embodiment, bore 104 is axially aligned with dispensing cylinder 44. Similarly, lower surface 103 of top wall 41 includes a bore 105 in axial alignment with bore 104, and together form a through aperture having two different diameters.

Cover plate 50 has an upper surface 107, a lower surface 108 and spaced apart sidewalls 109 and 110 respectively. Lower surface 108 includes a dado 111 for accepting second end 47 of dispensing cylinder 44 for attaching cover plate 50 to dispensing cylinder 44.

A number of bolts 112 (FIGS. 1–2) extend through cover plate 50 and along the exterior of dispensing cylinder 44 to engage apertures (not shown) in push rod clip 36. In this manner, bolts 112 may be removed and the dispensing assembly 3 disassembled to permit cleaning and replacement of worn parts in a relatively quick and inexpensive manner.

In accordance with another feature of the invention, a single dispensing piston 120 is used to control the simultaneous discharge of both fluids simultaneously from their respective holding cavities 55 (FIG. 6). Dispensing piston 120 is complementarily shaped and is mounted in the interior of dispensing cylinder 44, and has two annular recesses 121 extending around its sidewall. Recesses 121 each house a respective annular seal 122 for sealing the engagement between piston 120 and dispensing cylinder 44. Further, a magnetic ring 123 is attached to piston 120 and may be used with an external magnetic control (not shown) of the type generally known in the art to enable the position of piston 120 to be known at all times. Ring 123 may be of a variety of shapes, and may be attached to piston 120 by any convenient attachment means. A key-shaped recess 124 (FIG. 2) extends into the lower surface of piston 120 and accepts a control end 125 of a piston rod 126 which is complementarily sized to fit within bore 105 in push rod clip 36. An annular seal 127 is recessed in bore 105 to seal the engagement between bore 105 and piston rod 126.

A free end of rod 126 includes two key-shaped recesses 130 for accepting ends of a pair of push rods 129 (FIGS. 2 and 6). Rods 129 pass through apertures 101 and extend into holding cavities 55, the purpose of which will be described in detail hereinbelow. Annular seals 58 seal the engagement between cavities 55 and rods 129.

A micrometer stop gauge indicated generally at 115 (FIG. 2), includes a knurled knob 116 for actuating the stop gauge. A stop 117 extends through a hole 113 formed in cover plate 50 and is adjustable into and out of dispensing cylinder 44 for increasing and decreasing the effective stroke of dispensing piston 120. The distance that stop 117 extends into cylinder 44 may be varied via a well known threaded adjustment mechanism (not shown) between knob 116 and stop 117. The purpose for such adjustment will become more apparent hereinbelow. A set screw 118 extends through an aperture in top cover plate 50 such that when gauge 115 is set, set screw 118 may be tightened against a lateral surface of stop 117 to secure it in position.

Figure 7:
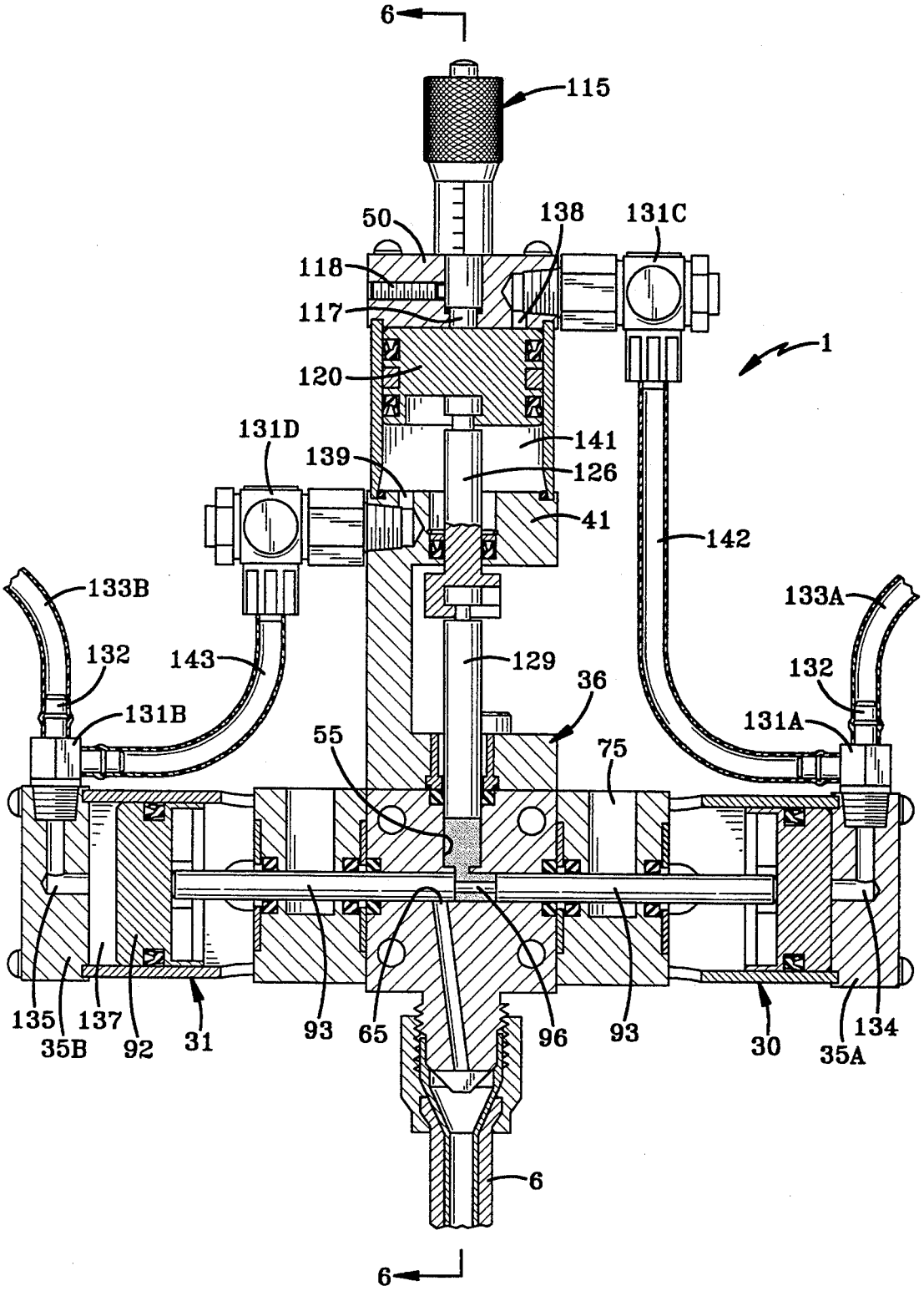
FIG. 7 is a sectional view of the device shown in a first operating position.

Referring next to fluid system 4 and to FIG. 7, cover plates 35 and 50, and top wall 41 of push rod clip 36, each include a respective air fitting 131A–131D. Fittings 131A and 131B are of the straight flow through type, and each includes air inlets 132 attached to a corresponding air supply hose 133 which is connected to a usual source of pressurized fluid, which is usually air, for supplying air to operate device 1. Fitting 131A and 131B also communicate with conduits 134 and 135 respectively, to channel air into respective cavities 136 (FIG. 8) and 137 (FIG. 7) created by valve cylinders 30 and 31. Similarly, conduits 138 and 139 communicate with fittings 131C and 131D respectively, to channel air into respective cavities 140 (FIG. 10) and 141 (FIG. 9). Fittings 131C and 131D are flow control fittings which have a reduced size orifice therein which is sized so that pistons 92 move faster than piston 120 to control the discharge of the fluids from cavities 55 as discussed below. Cavities 140 and 141 are essentially formed on opposite sides of dispensing cylinder 44 and are separated by dispensing piston 120. A hose 142 connects fitting 131A and 131C, while hose 143 connects fittings 131B and 131D. Each hose 142 and 143 provides air to the fittings 131C and 131D at various points in the operation cycle as will be described in detail below.

Turning to the operation of device 1 (FIGS. 7–10), FIG. 7 shows the starting position of device 1 wherein the single dispensing piston 120 is in a retracted position and spools 93 are in a load position. Also, the description presumes that micrometer stop gauge 115 has been appropriately adjusted to assure that the proper size shot is dispensed. When device 1 is in the position shown in FIG. 7, material inlet ports 60 are in alignment and communicate with central portions 96 of spools 93. When inlet ports 60 are opened, material will be fed into central portions 96, and via the communication between portions 96 and holding cavities 55, cavities 55 are also filled with material. Note that portion 96 is not in communication with material outlet port 65 when in this load position (FIGS. 4 and 7).

Figure 8:
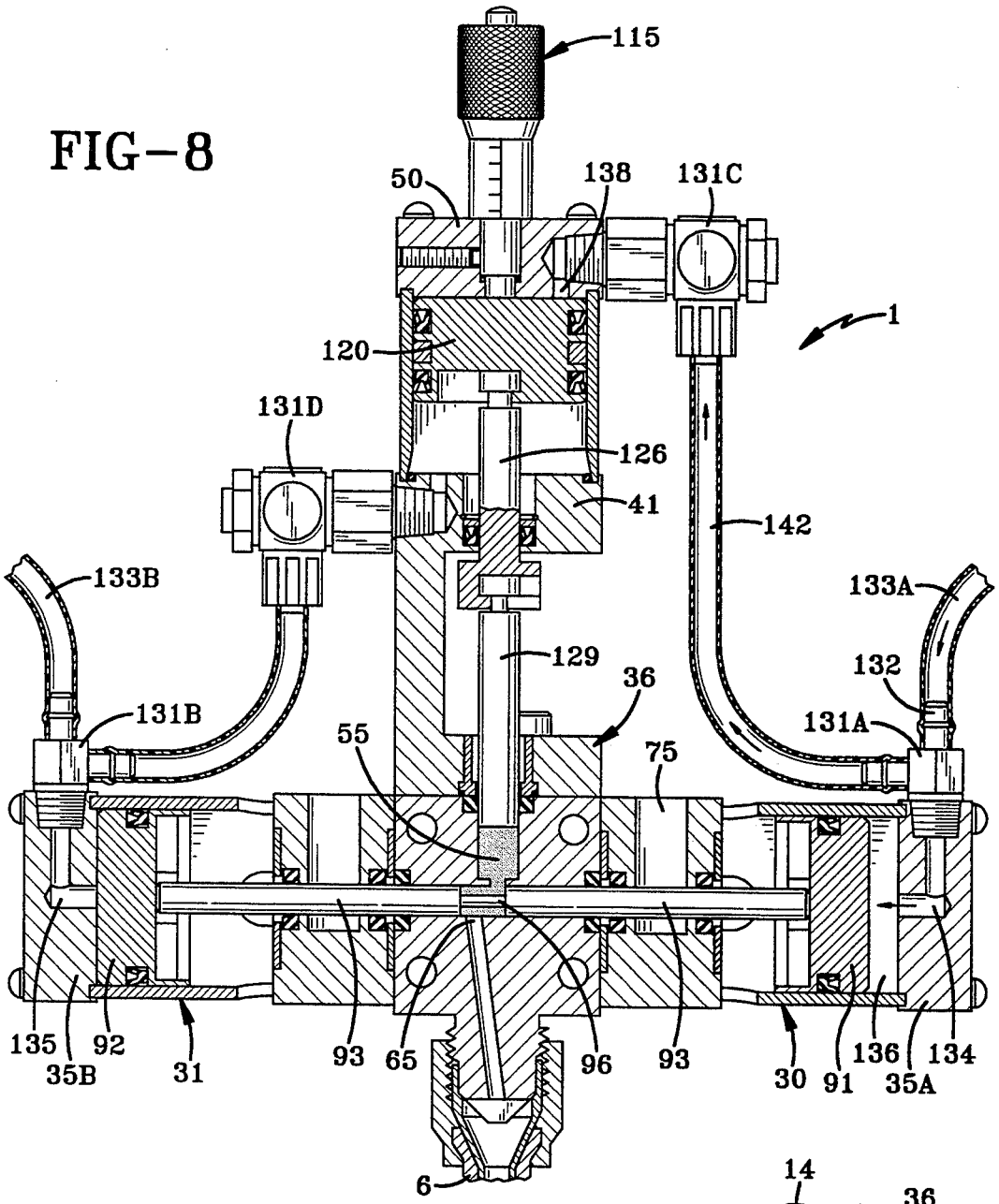
FIG. 8 is a sectional view similar to FIG. 7 shown in a second operating position.
Figure 9:
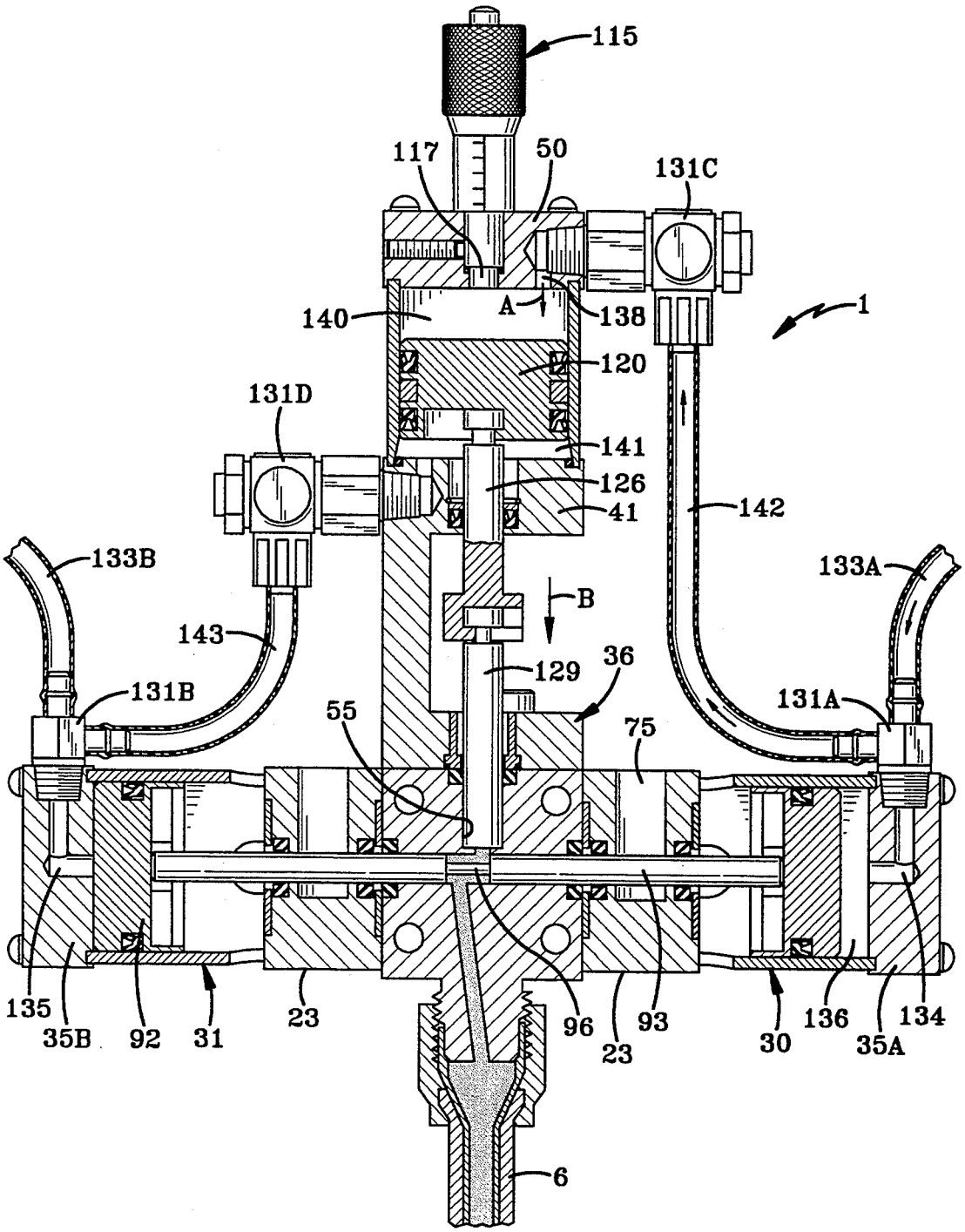
FIG. 9 is a sectional view similar to FIGS. 7 and 8 showing a third operating position.

Once cavities 55 and central portions 96 are filled with material, air is supplied from a usual supply of compressed air (not shown) into the right hand supply hose 133, through conduit 134, and into cavity 136 (FIG. 8). This air then moves piston 91 and spools 93 toward cover plate 35B. Such movement causes central portions 96 to be moved out of communication with material inlet ports 60, and into communication with material outlet ports 65 (FIG. 8).

Air is also being fed through supply hose 142 and into fitting 131C, and then through a passage 138 into cavity 140 (FIG. 9). Due to the control feature of fitting 131C, air is fed more slowly into cavity 140 than cavity 136 so that central rod portion 96 reaches the position of FIG. 9 when piston 120 begins to move downwardly. The air pressure in cavity 140 acts upon the upper surface of dispensing piston 120 to force piston 120 downward in the direction of arrow A (FIG. 9), toward valve assembly 2. As piston 120 is moved downwardly, piston rod 126 and push rods 129 are also forced downward in the direction of arrow B. As push rods 129 are forced downwardly, they enter holding cavities 55 and force the materials held therein through central portions 96 (FIG. 9) of spools 93 and into outlet ports 65, and then into dispensing tip 6. The volume of the dual materials held within cavities 55 are thus dispensed out of tip 6 in accordance with one of the main features of the invention. It is noted that central portions 96 are not in communication with the material inlet ports 60 during the dispensing stage in FIG. 9.

Once a shot (not shown) is dispensed from static mixer tip 6, cavities 55 are in the empty position shown in FIG. 9. Device 1 must be reset to the reload position shown in FIG. 10 by supplying air through supply hose 133B. As the air enters fitting 131B, it is simultaneously routed through hose 143 to control fitting 131D, and through conduit 139 and into cavity 141. Air pressure thus acts against valve piston 92 and the bottom surface of dispensing piston 120 to move them into the position shown in FIG. 10. This movement moves central rod portions 96 out of communication with material outlet ports 65 and into communication with material inlet ports 60 to accept new shots of the dual materials. This movement also withdraws push rods 129 from holding cavities 55. Dispensing piston 120 will be moved via air pressure from its lowered position of FIG. 9 until stop 117 is contacted at its raised position. Thereafter, the air pressure will escape through the check valve in fixture 131D. It is noted that holding cavities 55 are in communication with central portions 96 both when rod portions 96 are communicating with material inlet ports 60 and material outlet ports 65.

Central portions 96 of spools 93 are sized such that they sever communication with inlet ports 60 before they initiate communication with outlet ports 65. Similarly, portions 96 are not in communication with outlet ports 65 when they move to the reload position shown in FIG. 10, where they are in exclusive communication with inlet ports 60. This exclusive communication is required so that material does not flow directly from material inlets 60 to material outlets 65 without first being held in cavities 55. Cavities 55 must retain the dispensed material first, as this assures that an exact volume of material will be positively dispensed.

Further, as spools 93 are moved from the position shown in FIG. 7 to that shown in FIG. 8, the spools are lubricated as they pass through reservoir members 20 and 21. Baths 75 are filled with lubricating liquid, and seals 74 assure that the lubricating liquid does not enter the dispensing chamber and compromise the purity of the dispensed material. Annular seals 54 and 58 assure that dispensed material does not leak out of cavities 55 which could compromise the purity of the fluid, and also the accuracy of the dispensed shot.

Figure 10:
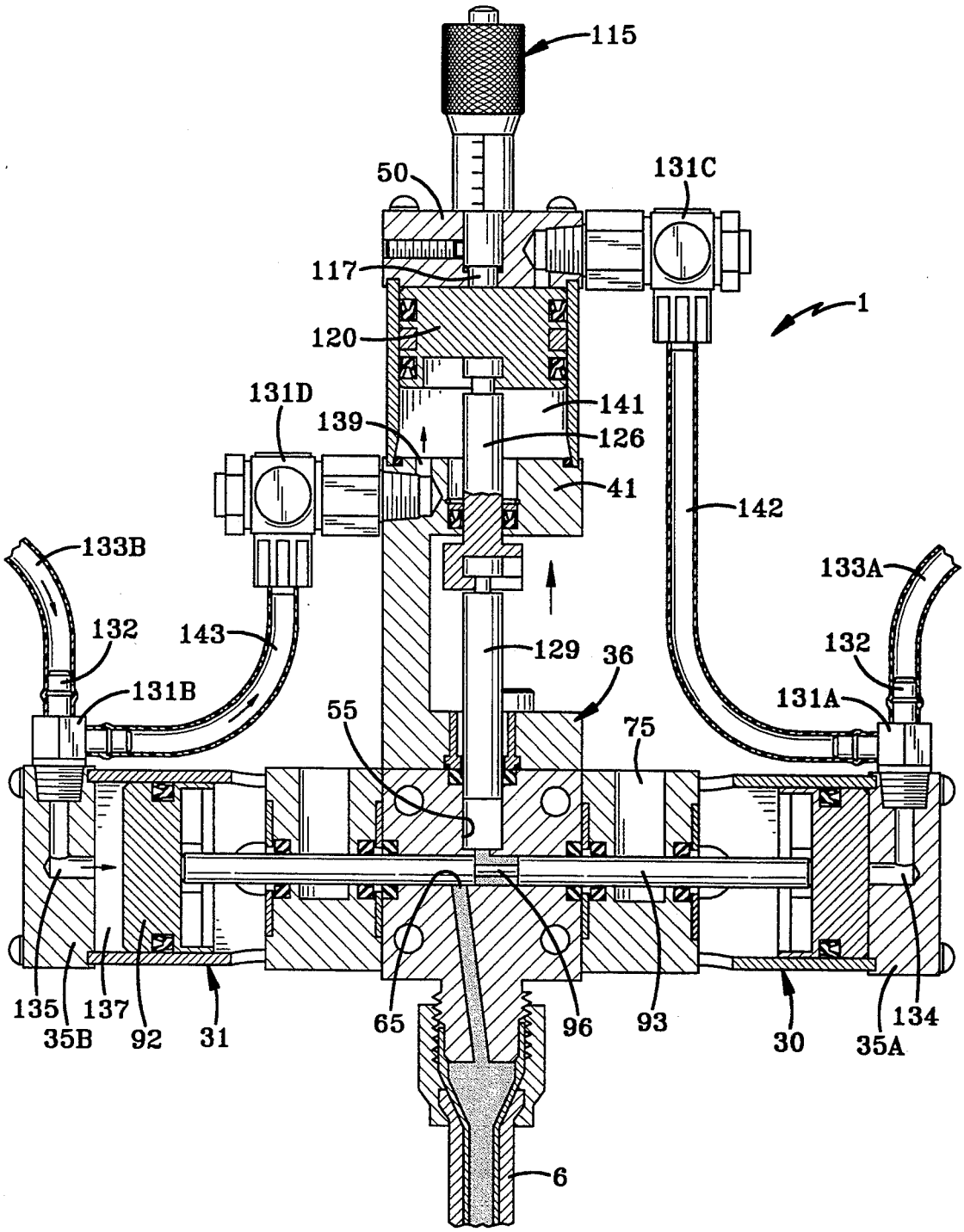
FIG. 10 is a sectional view similar to FIGS. 7—9 showing a fourth operating position.

Before the material is dispensed, the shot size must be determined. The size of the shot to be dispensed is set by holding cavities 55, which cavity size may be enlarged simply by withdrawing push rods 129 from cavities 55 (FIG. 10). Similarly, the size of cavities 55 may be decreased by inserting the push rods 129 further into the cavities. Inasmuch as dispensing piston 120, piston rod 126 and push rods 129 are rigidly connected, the height piston 120 rises corresponds to the height push rods 129 are withdrawn from cavities 55. Therefore, if stop 117 is lowered into cylinder 44, piston 120 will not move as far upwardly into cylinder 44 and push rods 129 will not be withdrawn as far from cavities 55. Thus, micrometer 115 may be adjusted to vary the size of holding cavities 55 and the size of the dispensed shot.

Figure 5:
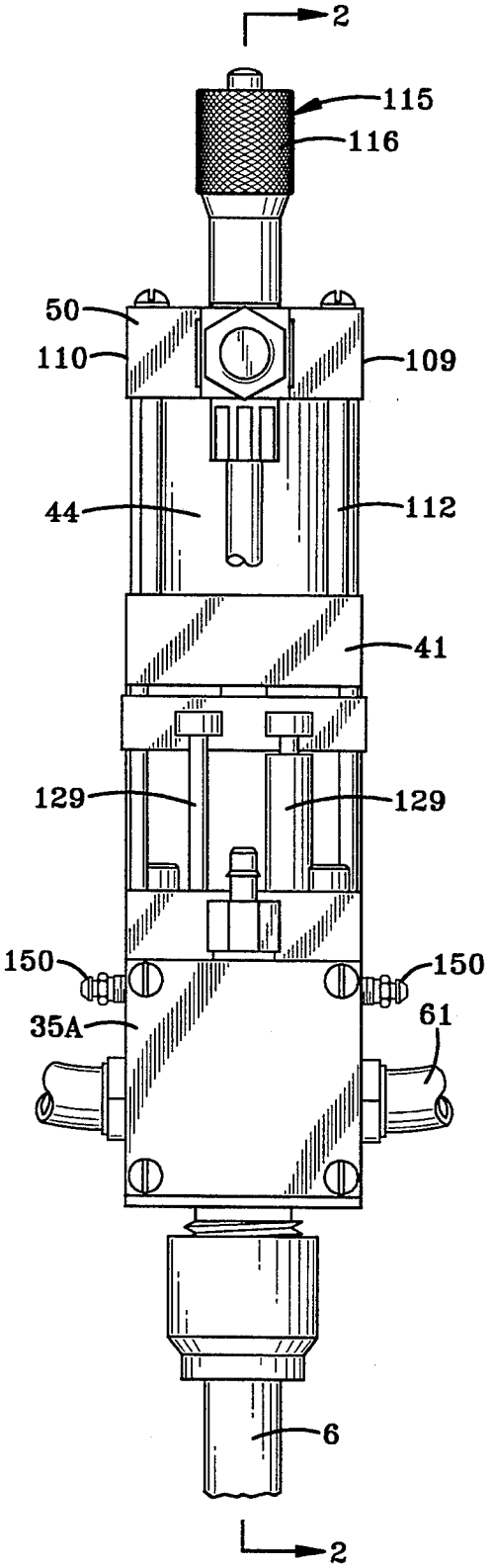
FIG. 5 is a side elevational view of the device shown in FIG. 1.

It should be noted, that the diameter of each holding cavity 55 may be varied without departing from the spirit of the present invention. Specifically, as shown in FIGS. 5 and 6, the holding cavities 55 have varying diameters, and consequently vary in volumes such that mixtures requiring different volumes of materials in each dispensed shot, may be accurately dispensed simultaneously.

As should also be apparent to one of ordinary skill in the art, central portions 96, having an area of reduced material thickness, could be substituted with a central portion having an outer diameter substantially equal to that of spools 93, but which central portions 96 provide an aperture therethrough for communication with both the material inlet port 60 and material outlet port 65.

The graduations 141 on gauge 115 may be in length of distance traveled by the push rods, or alternatively, these graduations may reflect the volume of cavities 55 at various positions of stop 117, and thus at various positions of push rods 129, when rods 129 are in the fully withdrawn position.

Figure 11:
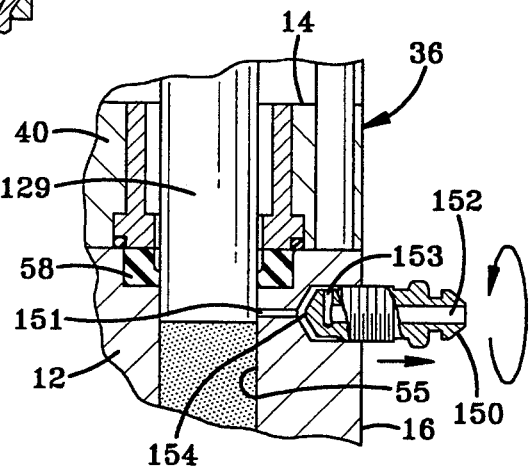
FIG. 11 is an enlarged fragmentary view of the encircled portion of FIG. 6 showing one of the purge screws.

In accordance with another feature of the invention, a pair of bleed screws 150 is mounted in base 12 and communicate through passages 151 with cavities 55 (FIGS. 6 and 11). Each bleed screw 150 includes a bore 152 which communicates with passage 151 through a side inlet 153. Bleed screws 150 enable any air bubbles to be purged from holding cavities 55 and runners 64 at the start of a dispensing operation. Bleed screws 150 are loosened as shown in FIG. 11, to provide communication from cavities 55 through side inlet 153 and bore 152, and upon the first shot or two being dispensed any air within the cavities and associated runners will flow around the rods 129 as they move into cavities 55 and then out through bleed screw bore 152. As soon as a small quantity of fluid flows through bores 152 the bleed valves are then tightened whereby the conical tips 154 thereof close off passages 151. Thus, this ensures that there are no air bubbles remaining in any of the cavities and passages which could affect the flow of either material into static mixer tip 6. Again, when device 1 is used for dispensing a very small amount or shot of the dual materials, the presence of an air bubble in one of the cavities or runners will affect the amount of material flowing therethrough, which in turn will affect the quality of the final shot produced thereby.

It is also readily understood by anyone skilled in the art that the pressurized fluid system for moving pistons 91, 92 and 120 could be replaced with an electric, hydraulic or similar types of well known actuating systems without effecting the invention.

Accordingly, the improved mixing, metering and dispensing device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved trailer hitch guide is constructed and used, the characteristics of the construction, and the advantageous, new and useful results obtained; the new and useful structures, devices, elements, arrangements, parts and combinations, are set forth in the appended claims.

We claim:

1. A device for metering, mixing and dispensing at least two liquid materials comprising:

a housing defining a pair of chambers each communicating with a material inlet port and a material outlet port for dispensing a respective material therefrom;

a spool slidably mounted within each of the chambers wherein said spools communicate discretely with said material inlet and outlet ports;

a holding means in communication with each of the chambers for receiving and holding a volume of one of the materials after said materials enter said inlet ports and passes said spools;

a single first pressure means for forcing the materials simultaneously out of said holding means and past said spools and through said material outlet ports; and second pressure means for slidably moving the spools between a first position where said holding means are in communication with said material inlet ports, and a second position where the holding means are in communication with said material outlet ports.

2. A device as defined in claim 1 wherein each of said spools has first and second ends; and in which said second pressure means further comprises a first piston slidably mounted in a first cylinder, and a second piston slidably mounted in a second cylinder, wherein said first and second pistons each engage a respective first and second end of the spools.

3. A device as defined in claim 2 wherein the second pressure means further comprises a source of pressurized fluid which operatively engages the first and second pistons.

4. A device as defined in claim 1 wherein each of the spools includes opening means for allowing material to flow therethrough when said spools are in the first and second positions in communication with the material inlet ports and material outlet ports, respectively.

5. A device as defined in claim 4 wherein the spool opening means each includes a central portion of reduced material thickness adapted to allow material to flow therearound.

6. A device as defined in claim 5 in which the opening means of the central portion is sized such that communication between said central portion and the material inlet port is severed before the inception of communication between said central portion and the material outlet port, and communication between the material outlet port and said central portion is severed before the inception of communication between said central portion and the material inlet port.

7. A device as defined in claim 1 wherein the first pressure means is a single piston slidably mounted within a dispensing cylinder, which piston has a pair of rods connected thereto extending into said pair of holding means.

8. A device as defined in claim 7 further comprising stop means for altering the volume of the holding means.

9. A device as defined in claim 8 wherein the stop means includes a calibrated stop extending through a wall of the dispensing cylinder and contacting the dispensing piston when the piston is in an uppermost position; and means for moving the stop means within the cylinder to increase and decrease the length of travel of said piston in said cylinder.

10. A device as defined in claim 7 wherein each of the holding means comprises a cavity complementarily shaped to an end portion of a respective one of the rods; and in which the holding means is in communication with said end portions of said rods such that said rods move into and out of said cavities.

11. A device as defined in claim 1 further comprising bath means for holding a lubricating fluid circumferentially around a portion of each of the spools.

12. A device as defined in claim 1 including bleed valve means in communication with the holding means for removing air from within said holding means.

13. A device as defined in claim 12 in which said bleed valve means includes a bleed screw having a hollow bore movably mounted within a threaded opening, which opening communicates with a respective holding means.

14. A method of metering, mixing and dispensing a pair of liquid materials from a device of the type having a pair of material inlet ports, and a pair of material outlet ports, said method comprising the steps of:

a) moving a pair of valves simultaneously into discrete communication with said material inlet ports;

b) injecting material through said inlet ports and said valves, and into a pair of holding cavities, each of said holding cavities being defined by a cylinder and a push rod, which rod is moved into and out of said holding cavity;

c) moving the valves out of communication with said material inlet ports;

d) after said valves are moved out of communication with said material inlet ports, initiating communication with said material outlet ports;

e) moving said push rods into said holding cavities to force the materials held therein out of said cavities through said valves, and out of said material outlet ports;

f) withdrawing said push rods from said holding cavities, and moving said valves out of communication with said material outlet ports; and g) moving said valves into communication with said material inlet ports after said valves cease to communicate with said material outlet ports.

15. A method of metering, mixing and dispensing a pair of materials as defined in claim 14 comprising the further step of adjusting the distance which said push rods withdraw from said holding cavities.

16. A method of metering, mixing and dispensing a pair of materials as defined in claim 14 including the step of bleeding air from the holding cavities.

17. A method of metering, mixing and dispensing a pair of materials as defined in claim 14 including the steps of providing a supply of pressurized air; injecting a portion of said pressurized air into contact with the valves for moving said valves; and directing another portion of said pressurized air into contact with a piston for moving the push rods.

18. A method of metering, mixing and dispensing a pair of materials as defined in claim 14 including the step of applying a lubricant onto the valves as said valves move between communication with the material inlet and outlet ports.

19. A method of metering, mixing and dispensing a pair of materials as defined in claim 14 including the step of bringing the two liquid materials together at the entrance of a static mixer.

* * * * *